United States Patent [19]

Korshunov

[11] 4,059,001

[45] Nov. 22, 1977

[54] MILL FOR ROLLING CONTINUOUSLY CAST INGOT

[76] Inventor: Evgeny Alexeevich Korshunov, pereulok Otdelny, 5a, kv. 29, Sverdlovsk, U.S.S.R.

[21] Appl. No.: 730,648

[22] Filed: Oct. 7, 1976

[30] Foreign Application Priority Data

Oct. 15, 1975 U.S.S.R. ..... 2177701
Oct. 15, 1975 U.S.S.R. ..... 2177702

[51] Int. Cl.[2] ..... B21B 31/00; B21B 35/00
[52] U.S. Cl. ..... 72/214
[58] Field of Search ..... 72/214, 220, 193, 208, 72/209, 56

[56] References Cited

U.S. PATENT DOCUMENTS 2,161,064 6/1939 Krause ..... 72/214
2,903,925 9/1959 McNulty ..... 72/214

*Primary Examiner*—Milton S. Mehr
*Attorney, Agent, or Firm*—Lackenbach, Lilling & Siegel

[57] ABSTRACT

A rolling mill comprising a mill stand which is mounted on a movable stage and in which are mounted grooved mill rolls whose necks are connected with hydraulic drives and gear wheels in mesh with each other. The movable mill stand is provided with at least two pairs of inductors mounted on a bottom-mill separator intermediate of housing braces. The inductors are disposed above and under the continuously cast ingot, referred to hereinafter as a continuous casting, being rolled, on both sides of the mill rolls. The inductors establish in said rolled continuous casting inductive currents which heat said casting, and electromagnetic forces, which create through the inductor bodies pulling-and-pushing forces which are applied to the movable mill stand.

4 Claims, 11 Drawing Figures

MILL FOR ROLLING CONTINUOUSLY CAST INGOT

The present invention relates to metallurgy and more particularly to mills for rolling a continuously cast ingot, referred to hereinafter as a continuous casting, said mill being mainly designed for rolling a casting whose motion alternates with standstills.

Known in the art are rolling mills designed for direct rolling of a continuous casting.

These mills include multiple-stand continuous mills, as well as pendulum and planetary rolling mills.

Said mills for direct rolling of a continuous casting have found wide application when the casting is being withdrawn from a mould continuously.

Where a need arises for rolling a continuous casting which moves intermittently, i.e. whose travel alternates with standstills, application of said mills is practically inexpedient. In this case their power requirements increase substantially with a rather small utilization factor ranging from 10 to 30%.

In this case adopted as a prototype is a rolling mill adapted preferably for rolling a continuous casting whose travel alternates with standstills. A patent for that mill is now pending in Japan (No. 135772/1973, December 6, 1973). Patents for that mill are pending in Great Britian (No. 55740, February 30, 1974), Canada (No. 186549, Nov. 23, 1973), and the United States No. 422071, Dec. 5, 1973, for a method, and for a mill (the number not yet being known)).

Said mill comprises slideways which are mounted on a foundation and along which a movable mill stand travels, said mill stand incorporating a bottom- and a top-mill separator and two housings, each housing having two braces between which are disposed roll chocks with bearings in which are mounted grooved mill rolls having necks. Said roll necks carry gear wheels which are meshed with racks whose ends are connected with connecting rods of hydraulic cylinders fastened on the housing braces. Apart from the hydraulic drive adapted for rotating the mill rolls, said mill has another drive for reciprocation the movable mill stand.

As the continuous casting is being rolled on said mill, the movable mill stand reciprocates and is displaced towards an unrolled portion of said continuous casting after each working stroke until the sum of said displacements is equal to the length of the casting extracted from a mould over a withdrawal period. Next the movable mill stand is displaced towards the rolled part of the casting over a distance equal to said sum of the displacements, the rolling process being continued when the next portion of the casting has been withdrawn from the mould.

Said rolling mill allows efficient rolling of a continuous casting whose motion alternates with standstills by making use of relatively small roll forces, thus limiting to a certain extent the mill production. If the mill is equipped with a more powerful drive with the ensuing enhancement of the roll force, the resulting rolling rate will increase, but the arrangement of said more powerful drive on the braces of the movable mill stand presents a problem.

The main object of the invention is to provide a mill for rolling a continuously cast ingot, referred to hereinafter as a continuous casting, which would, on the one hand, allow creating a considerably higher, as compared with the prior-art mill, roll force by making use of a mill roll drive of the same rating and which would provide, on the other hand, along with a greater roll force, a mill with a casting of a lower deformation resistance, owing to the heating of its rolled portion and to the tensioning of said casting in the area of deformation. All these factors will ultimately enable a considerable increase in the reduction of a continuous casting during each working transfer of a movable mill stand.

Another object of the invention is to obviate the use of an individual drive for idle transfer of a movable mill stand.

Still another object of the invention is to decrease the formation of oxides at the surface of a continuous casting both in a rolling zone and in the portions adjacent thereto, said decrease being ensured among other reasons by additional heating of said continuous casting.

Yet another object of the invention is to provide a possibility of effecting on the proposed mill special operations, such as the melting of a part or of the entire surface of the unrolled portion of the casting, thermomilling of defective spots of a continuous casting, said operation being combined with rolling, and, finally, the rolling of a continuous casting in a fluid.

Said and other objects are accomplished by providing a mill for rolling a continuously cast ingot, referred to hereinafter as a continuous casting, said mill being mainly designed for rolling a casting moving alternately with standstills, said mill comprising slideways which are mounted on a foundation and along which a movable mill stand travels, said mill stand being arranged on a stage and a comprising a bottom- and top-mill separator and two housings, each housing having two braces between which are disposed roll chocks with bearings, in which are mounted the necks of grooved mill rolls, said necks being connected with hydraulic drives fastened on the housing braces and with gear wheels meshed with each other.

According to the invention, the movable roll mill stand has at least two pairs of inductors mounted intermediate of the housing braces on the bottom-mill separator of the movable stand, the inductors in each pair being arranged above and under the casting being rolled on both sides of the mill rolls, thus establishing in said rolled casting inductive currents, which heat the casting, and electromagnetic forces, which create through the inductors bodies pulling-and-pushing forces which are applied to said movable mill stand.

As compared with the prior-art mills, the mill of the invention that has been developed for rolling a continuous casting has less powerful roll drives, ensures the requisite heating of the rolled continuous casting, effects heating concurrently with its rolling which makes it possible to strike special-purpose heating appliances off the list of the caster process equipment, and ensures savings in both the outlays and the mill operating cost.

It is expedient that brackets be arranged on the end face walls of the inductors located at the entry and exit sides of the rolled continuous casting, each bracket having mounted, thereon at least one guide roller, the brackets having the guide rollers mounted on the inductor end face walls so as to provide a requisite clearance between the continuous casting being rolled and the inductors, which will ensure an accurate transfer of the casting being rolled intermediate of said inductors.

It is also expedient that an additional pair of inductors with an individual power supply source be mounted in the mill from the side of the unrolled part of the casting, thus ensuring various heating rates of the casting surface layers and, hence, the preprocessing of said continuous casting before rolling with a view to improving the quality of a rolled product.

The end face walls of the inductors located from the side of the unrolled part of the continuous casting preferably have mounted thereon a device with processing heads which would enable surface flaws to be removed from the unrolled part of said casting.

The present invention will be better understood from a consideration of a detailed description of an exemplary embodiment thereof, to be had in conjunction with the accompanying drawings, in which.

Figure 10:
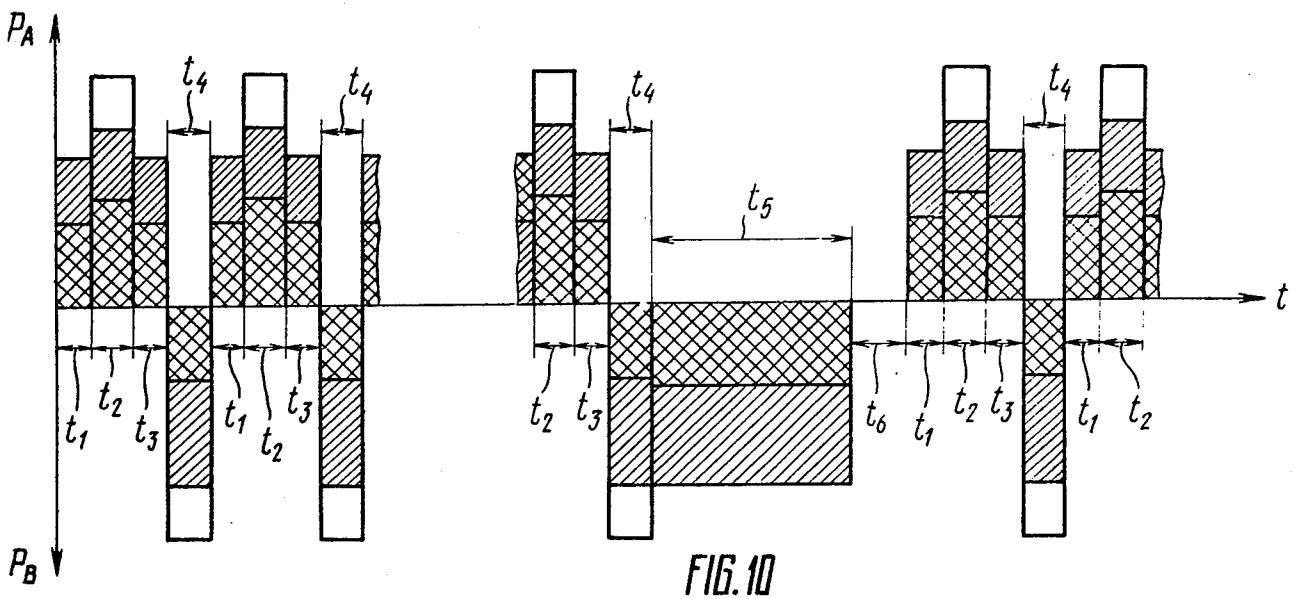
Figure 11:
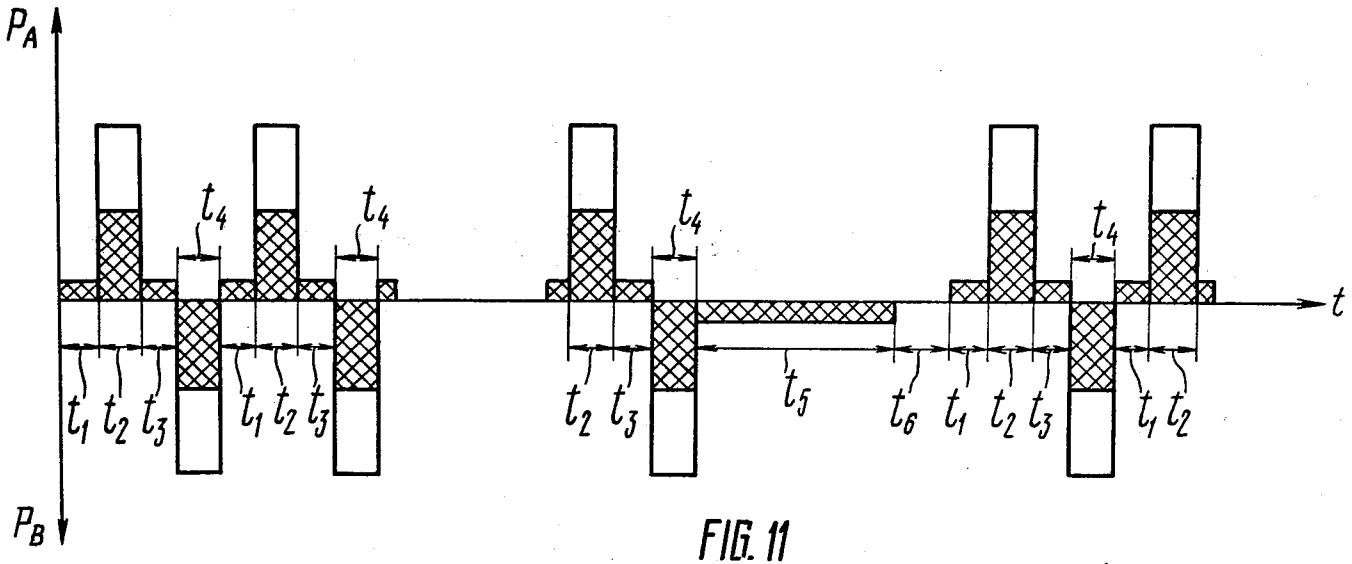

FIG. 10 is a diagram of the forces acting on said movable mill stand, which could provide for induction heating of the continuous casting being rolled, for setting up of tensile stresses in the area of deformation and for rolling said casting by the action of a mill roll drive and by a pulling or and a pushing force developed with the aid of inductors; and FIG. 11 is a diagram of the forces acting on said movable mill stand, which for induction heating of only the unrolled part of said casting.

Figure 1:
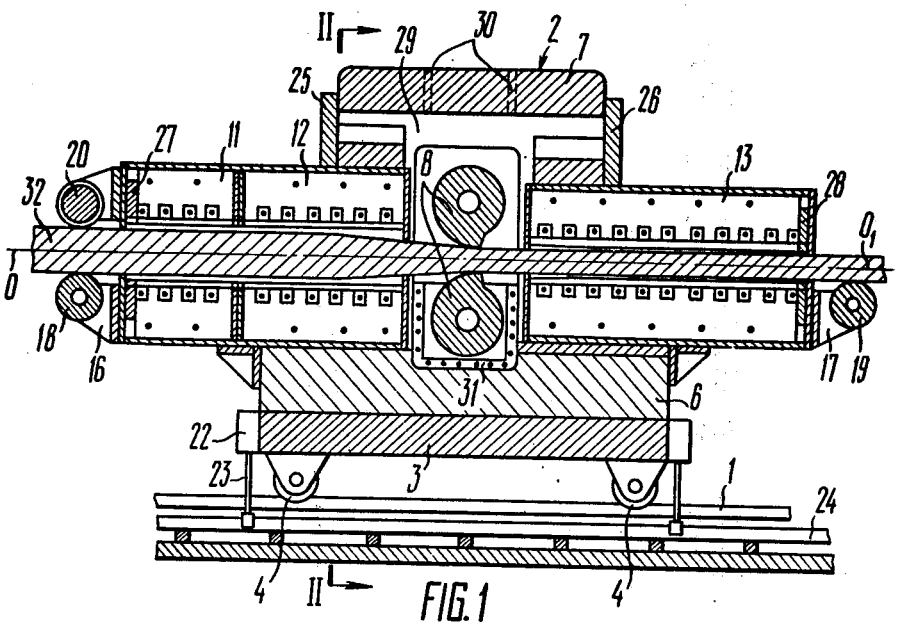
FIG. 1 is a general view of a rolling mill, according to the invention, a section being taken along its main axis.
Figure 2:
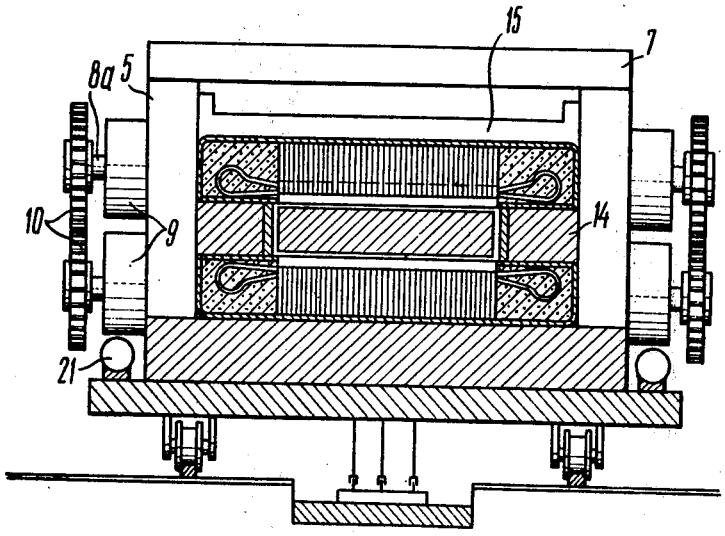
FIG. 2 is a cross sectional view taken along the line II—II in FIG. 1.

With reference to FIGS. 1 and 2, a mill is provided with two slideways 1 mounted on a foundation (not shown in the drawing) parallel to the axis of rolling $OO_1$.

A movable mill stand 2 is mounted on a stage 3 which is provided with two pairs of rollers 4 with rims. The weight of both the movable mill stand and the stage is transmitted through said rollers 4 onto the slideways 1.

The movable mill stand 2 has two housings 5 fastened on a bottom-mill separator 6. From above the housings 5 are held together by a top-mill separator 7. Fixed in apertures in the housings are the chocks (not shown in the drawings) of grooved mill rolls 8. The necks of said grooved rolls are mounted in chock bearings. Tail parts 8*a* of said roll necks project outside the chocks and are connected to hydraulic engines 9, whose casings are fastened on the housings 5, and to gear wheels 10 meshed with each other and assembled by a stationary fit. The gearings are enclosed by casings (not shown in the drawing).

Mounted on the bottom-mill separator 6 of the movable stand 2 on each side of the mill rolls 8 either between the braces of the housings 5 or close to said braces are the pairs of preferably flat inductors 11, 12 and 13, spreader bars 14 being set up therebetween at the edges. The spacing between the pairs of inductors 11 and 12 and between the spreader bars 14 corresponds to the size of the unrolled part of a continuous casting, and the spacing between the spreader bars and the inductors 13 corresponds to the size of the rolled casting with due accont to the clearane that must be provided between the inductors, spreader bars and the casting being rolled.

Two pairs of said inductors 11 and 12 are mounted from the side of the unrolled part of the casting. A need for individual inductors 11 and 12 is attributable to the fact that they are powered from different power sources. Thus, one pair of said inductors is fed with an electric current of a higher frequency by which virtue the heating of metal surface layers can be effected in a different mode than the melting of said surface layers, if required. Sometimes, to facilitate the removal of molten metal from the surface of the continuous casting, the inductors powered by a high-frequency current are preferably mounted so as to permit the removal of said molten metal from the flat sides of the casting. It should be noted that if the heating schedule of the casting surface layers does not have to be varied, two pairs of said inductors 11 and 12 can be replaced by one pair.

From above the inductors 12 and 13 are secured by transverse beams 15 attached to the braces of the housings 5.

Connected to the extreme end face of the inductors 11 and 13 are brackets 16 and 17 with rollers 18 and 19 which are adapted to support and guide the continuous casting being rolled, said rollers 18 and 19 being mounted so as to provide the requisite clearance between the casting being rolled and the inductors during the feeding of the continuous casting to the mill rolls and during the rolling process.

If required, the roller 18, attached to the inductors end face wall located on the side of the unrolled part of the casting, can be replaced by a device for machining a casting surface. Said device can comprise, for instance, two milling heads mounted movably in a vertical plane above and beneath said continuous casting. The top milling head 20 is diagrammatically shown in FIG. 1, its drive not being shown in the drawing.

Laid on the stage 3 are two manifolds 21 of which one is the high-pressure and the other the low-pressure manifold. Said manifolds are connected with the aid of a pipe system to the mill roll hydraulic drives and to the cooling systems of certain mill units, such, as mill rolls, inductor windings, etc. (the pipings supplying coolant to and discharging it from said manifolds are not shown in FIGS. 1 and 2).

Fastened to the end face walls of the stage 3 are terminal boxes 22 through which electric power is supplied to the inductors. The terminal boxes 22 are powered by means of a flexible power cable or busbars 24 through current collectors 23. (Both the current collectors 23 and the busbars 24 are shown in FIGS. 1 and 2 diagrammatically, their actual embodiment being dependent on the operating conditions of the rolling mill).

By mounting sealing members 25 and 26 above the casings of the inductors 12 and 13 concordantly to the top-mill separator 7, as well as by arranging means 27 and 28 on the end face walls of said inductors to overlap the clearances between the casting being rolled, the inductors 12 and 13 and bars 14, a closed space 29 is formed in the rolling mill in the zone of the mill rolls and inductors.

In the top-mill separator 7 two holes 30 are made which can be either plugged or connected to corresponding systems for feeding either a gas or a fluid into said closed space 29. To preclude the solidifying of said fluid, especially at the beginning of the rolling process, provision is made for heating said fluid in a vessel 31 positioned near the bottom mill roll. One pair of side walls of said vessel 31, which is mounted on the bottom-mill separator 6 and accommodates the bottom mill roll, is in contact with the casings of the inductors 12 and 13, whereas the other pair of its walls, having special cutouts for the roll necks, is in contact with the roll chocks and can be introduced, if required, into said closed space 29 together with the mill roll unit.

In the process of operation of said rolling mill the casting being rolled is subjected to the requisite heating and rolling.

If the rolled part of said casting and its sections adjacent to said rolled portion must be protected against oxidation, rolling is carried out by feeding a nonscale gaseous medium into the closed space 29 through the holes 30. In this case in order to cut down gaseous medium consumption through the clearances between the inductors, the spreader bars and the casting, use is made of said means 27 and 28 to preclude the leakage of the gaseous medium from the space 29 through said clearances.

The proposed rolling mill is adaptable for rolling a continuous casting in a liquid medium that is fed into the space 29. If said liquid medium is not electrically conductive, the leakage through the clearances between the inductors and the casting is precluded by said means 27 and 28, whereas when the liquid medium is electrically conductive, the leakage is precluded by an electromagnetic field generated by the inductors.

The mill is adapted for carrying out two principal operations: the requisite preheating of the casting prior to rolling and rolling per se.

The required heating of the rolled portion of the continuous casting, as well as of its sections adjoining said rolled portion of the casting, can be effected by one of the following five embodiments, depending on the objects in view.

According to the first embodiment, while rolling a continuous casting, the mill rolls come out of contact with the rolled portion of said casting either after each or after a plurality of working transfers of the movable mill stand. The rolling technique also envisages the creation (by means of the inductors located on both sides of said mill rolls) of only pushing or only pulling forces of various magnitude acting on said movable mill stand, the difference in said forces being not less than the force required for an idle transfer of said movable mill stand along the slideways, the direction of said difference in forces being changed over a time period given for additional heating of the casting each time after the stand has been carried at a distance approximating the length of the casting extracted from the mould over the withdrawal period or after said stand has been shifted over a preset distance.

According to the second embodiment, the process of rolling of a continuous casting envisages developing by means of the inductors of such pulling-and-pushing forces, acting on said movable mill stand, which fail to provide the required roll force, an additional roll force being created in this case by the mill roll drive after a prescribed pause for additional heating of the casting.

In accordance with the third embodiment, the process of rolling a continuous casting envisages the developing with the help of inductors of such pulling-and-pushing forces, acting on said movable mill stand, which are not capable of providing the requisite roll force, the lacking force being created by the mill roll drive and the casting being reduced at a rate corresponding to a period of time required for said additional heating of said casting.

As to the fourth embodiment, the process of rolling a continuous casting envisages variations in the heating mode of the casting sections adjacent to its rolled part. The unrolled section located in the zone of action of the inductors is preferably heated by high-frequency currents until fusing of its surface layer, whereupon molten metal is removed from the casting surface under the effect of electromagnetic forces.

Finally, according to the fifth embodiment, the rolling technique of a continuous casting envisages the heating of sound casting sections and the melting (upon heating) of the surface layer on the casting section which contains surface flaws.

According to this embodiment, the unrolled portion of said casting containing the defects and disposed in the zone of action of the inductors is first heated at the same rate along the length of said portion, whereafter at the end of the time period given for heating said portion the rate of heating of the surface layer of said casting is changed along its depth, the defective section being heated to a melting point and the molten metal being removed from the surface of said casting section under the effect of the electromagnetic forces induced therein.

Surface finish of the unrolled casting and, hence, of the rolled casting is improved because during reciprocation of the movable mill stand the surface of the unrolled casting is subjected to machining with the ensuing removal of a surface layer having a prescribed thickness.

Deformation resistance of the casting and, consequently, the roll force diminish due to tensioning in the area of deformation due to the fact that the movable mill stand is subjected only to the effect of the pushing forces developed by the inductors arranged on both sides of the mill rolls. In this case when the movable mill stand is exposed to the action of forces similar in value, the casting is reduced by the rolling forces of the mill roll drive, whereas the mill stand exposed to dissimilar in valve forces, the casting is reduced owing to a difference in the pushing forces applied to the movable mill stand and by the force of the mill roll drive.

If it is required to avoid additional induction heating of the already rolled part of the casting, the pulling force applied to the mill stand is established due to a reaction brought about by the electromagnetic forces induced in the unrolled part of the casting during the working transfer of the movable mill stand towards said unrolled part of the casting, the pulling forces being in this case set up owing to a reaction brought about by the electromagnetic forces induced in the unrolled portion of the casting during the working transfer of said movable mill stand towards the rolled part of the continuous casting.

Upon preparing the continuous casting for rolling by masking use of the above technique, it is subjected to rolling proper.

To reduce the casting with the movable mill stand being shifted towards the unrolled and rolled parts of said continuous casting, the roll forces are developed due to the pulling-and-pushing forces acting on said movable mill stand, said forces being transmitted to said movable mill stand by means of the inductors mounted on both sides of the mill rolls.

The inductors are fed with an alternating current whose frequency is dependent on the particular conditions and can be equal to a standard (50 Hz) value or to lower or higher values. The preferred a.c. frequency is 50, 400–2000 Hz.

As an alternating current is being fed to the inductors, a travelling magnetic field is established therein, which permeates the casting being rolled, which is intermediate of said inductors, to a certain depth, thus setting up electromagnetic forces therein, which push said casting out of the space between said inductors. But insofar as the casting is of the continuous type and cannot be pushed out, the inductors and, hence, the entire movable mill stand are displaced with respect to the casting either to one or the other side depending on the direction of the travelling magnetic field in the inductors.

Free transfer of said inductors together with the movable mill stand with respect to the casting is precluded by the mill rolls. The movable mill stand is capable of displacement in a certain direction during its working transfer, when the mill rolls are in contact with the casting being rolled, only after said rolls have reduced the casting.

In their strive for shifting with respect to the casting the inductors develop a pulling force (set up by one pair of said inductors) and a pushing force (set up by the other inductor pair), and it is these forces that provide for creating a certain roll force in said mill rolls. This roll force can be sufficient for rolling the casting with a prescribed reduction degree. However, since the movable mill stand mounts also the roll drive, said roll force is created partly by said drive.

Simultaneously with the pulling-and-pushing forces developed under the effect of electromagnetic forces and applied to the movable mill stand, the continuous casting is heated with inductive currents. The rolled casting can remain in the zone of action of said inductive currents for a period of time ranging from several dozens of seconds to several minutes. But that period is sufficient to raise substantially the temperature of the casting in the rolling zone. Thus, the casting temperature can increase by several dozens of degrees, e.g. by 50°–200° C. The surface layers of said casting can be melted, if required. Due to said heating of the continuous casting the strength of the rolled metal decreases with the ensuing reduction in the required roll force.

The herein-proposed rolling mill is suitable for rolling a continuous casting that is being cast and moved continuously, but it is adaptable mainly for rolling a continuous casting moving intermittently.

Considered hereinbelow is a description of an exemplary embodiment of rolling a continuous casting moving intermittently, i.e. whose motion alternates with standstills.

Rolling of a continuous cast ignot is performed by grooved mill rolls.

Figure 3:
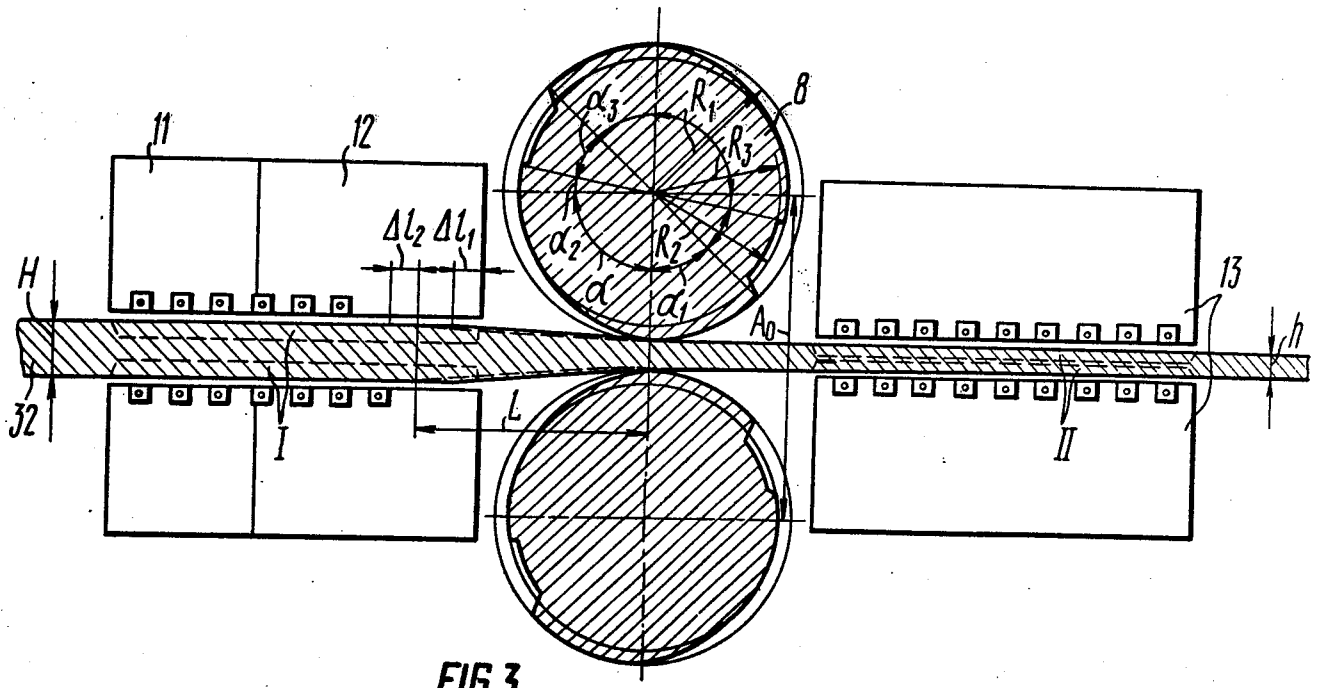
FIG. 3 is a layout of mill rolls and inductors indicating the zones of a continuous casting being rolled in which inductive heating currents are established, the length of the rolled part of said casting and the path of idle transfer of a movable mill stand.

Shown in FIG. 3 is the layout of the mill rolls and inductors, indicating the zones of action of inductive currents in the rolled casting. The drawing also shows a cross-section taken along the groove rolls, in which separate roll sections are specified.

The grooved mill rolls 8 have grooved sections, limited by an angle $\alpha$ and arcuated so as to provide the prescribed drafting schedule of a continuous casting 32 along the length of its rolled section L, and cylindrical sections located at the edges of said grooved sections and having various radii — a large one $R_1$ corresponding to a final thickness $h$ of the rolled casting 32 and limited by an angle $\alpha_1$, and a small one $R_2$ corresponding to the prerolled thickness H of the continuous casting being cast and limited by an angle $\alpha_2$.

Arranged between said cylindrical sections are idle portions limited by an angle $\alpha_3$ and having a radius $R_3$ (said idle roll portions can be not cylinder-shaped).

The mill rolls can comprise more than one groove section. Thus, the rolls, shown in FIG. 3, have two grooved sections each. In this case one pair of said grooved sections provided on the rolls is for standby use.

The roll profile is calculated to suit the adopted reduction degree of a casting being rolled, the length of its rolled portion L and the variations in deformation of said casting along its rolled section. The radii $R_1$ and $R_2$ are determined by the following formulas:

$$R_1 = \frac{A_o - h}{2}; \quad R_2 = \frac{A_o - H}{2};$$

where $A_o$ is the distance between the centres of the mill rolls.

When the rolling process envisages only the reduction of the rolled section L of a continuous casting and its heating with inductive currents over a period of time required for the movable mill stand to perform its working and idle transfers, the roll force, developed during each reduction over the period of transfer of said movable mill stand towards the unrolled portion of the casting, is created by means of the inductors 11, 12 and 13 (FIG. 3) due to the pulling force set up by the inductors 11 and 12 due to the reaction of the electromagnetic forces induced in the casting zone I and due to the pushing force developed by the inductor 13 due to the reaction of the electromagnetic forced induced in the casting zone II and owing to a moment created preferably by a hydraulic drive of said mill rolls.

Upon reduction of the casting with the movable mill stand shifting towards the unrolled portion of the casting, the mill rolls come out of contact with the rolled casting and are turned to their extreme fixed position only by the action of their drive, the movable mill stand being imparted an idle transfer over a distance $\Delta l_2$ towards the unrolled part of the casting, said transfer being accomplished only under the effect of the pulling-and-pushing force developed by means of the inductors 11, 12 and 13 or under the effect of either pulling or pushing forces established by one of said inductors.

After the movable mill stand with the stopped rolles has been carried a distance $\Delta l_2$, the power supply to the inductors is cut off.

Thereafter the mill rolls are reversed by their drive and as soon as the casting is again gripped by the rolls, power is again fed to said inductors 11, 12 and 13 by reversing the current direction. From that moment the movable mill stand commences its working transfer in the opposite direction, i.e. towards the rolled section L of the casting, which is being reduced with the pushing force applied to the movable mill stand, which is now created by means of the inductors 11 and 12, and the pulling force by the inductors 13.

On completion of the reduction of said casting the mill rolls will again come out of contact with the rolled strip, whereupon the movable mill stand is stopped, this being followed by its idle transfer over a distance $\Delta l_1$ towards the unrolled portion of the casting. After that, upon the next reversal of the mill rolls that is effected by their drive, the next reducing cycle is initiated.

Said rolling operation continues until the length of the rolled portion is equal to C, i.e. to the length of the casting portion extracted from the mould over the withdrawal period. Following that the movable mill stand with the stationary rolls enclosed therein is shifted (under the effect of the pulling or pushing force developed by the inductors) towards the rolled portion of the casting at a distance equal to the length of the casting portion extracted from the mould over the next withdrawal period.

Further after the next extraction of the casting from the mould, the rolling of the next casting portion is continued.

Figure 4:
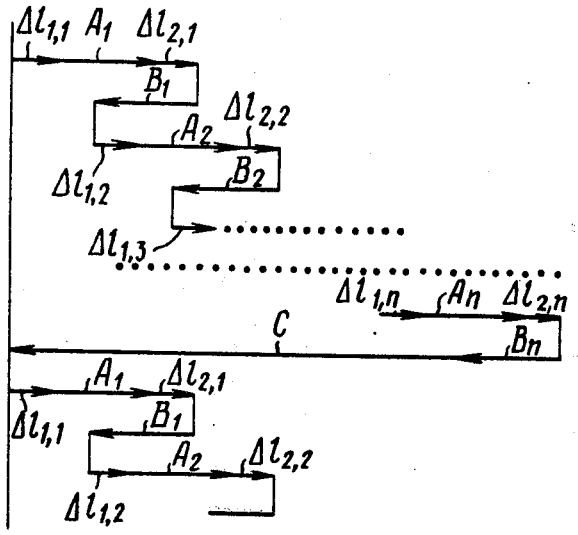
FIG. 4 shows diagrammatically the transfer of said movable mill stand during the steady-state process of combined casting and rolling of a continuous casting whose motion alternates with standstills.

FIG. 4 shows diagrammatically the transfers of the movable mill stand during the steady-state direct rolling process, i.e. during combined casting and rolling of a continuous casting whose motion alternates with standstills. (A indicates the working transfer of the movable mill stand towards the unrolled portion of the continuous casting, B indicates the working transfer of the movable mill stand towards the rolled portion of the continuous casting, and D indicates the idle reciprocation of the movable mill stand when the continuous casting is being subjected only to heating.)

The length C of the casting extracted from the mold during the withdrawal period is $$C = \sum_{i=n}^{i=l} (\Delta l_{1,i} + \Delta l_{2,i})$$

wherein $n$ is the number of working strokes of the movable mill stand during the pauses between the withdrawals of said continuous casting from the mold.

Figure 6:
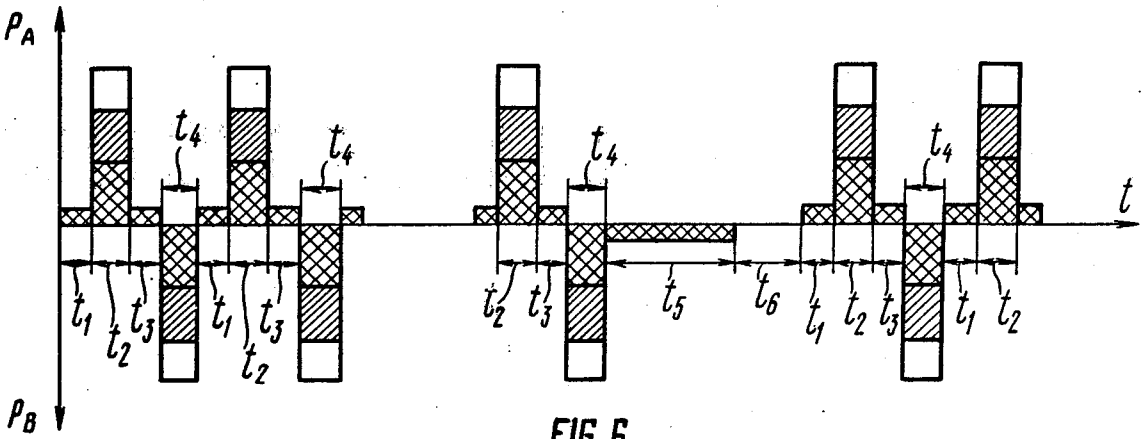
FIG. 6 is a diagram of the forces acting on the movable mill stand, which could provide for conventional or high-rate induction heating of the continuous casting being rolled.

Another possible embodiment for creating the forces acting on said movable mill stand for carrying out the above-outlined process of direct rolling of a continuous casting is presented diagrammatically in FIG. 6. ($P_A$ being the force acting on the movable mill stand during its transfer towards the unrolled portion of the continuous casting, and $P_B$ being the force acting on the movable mill stand during its transfer towards the rolled portion of the continuous casting.)

According to the layout of FIG. 4 and the chart of FIG. 6, the inductors 11 and 12 ensure an idle transfer of the movable mill stand over a distance $\Delta l_1$ within a time period $t_1$ by establishing a pulling force applied to the stand. Said transfer can be also effected by means of the inductors 13 which are able to carry the movable mill stand the above distance by creating a pushing force to act on said movable mill stand. The stand can also be displaced under the effect of all the inductors.

However, for the majority of the above embodiments of the rolling process an idle transfer of the movable mill stand at the distances $\Delta l_1$, $\Delta l_2$ and C, accomplished under the effect of the pulling and pushing forces created by means of the inductors 11 and 12 arranged on the side of the unrolled part of the casting, must be regarded as the preferable one, insofar as it provides more favorable conditions for the heating of yet unrolled portion of said continuous casting.

Further, over the time period $t_2$ the rolled portion of the casting is reduced, with the movable mill stand being carried a distance A towards the unrolled part of the casting under the effect of the pulling force set up by the inductors 11 and 12, the pushing force established by the inductors 13, and the force developed by the mill roll drive. At this time the pulling and pushing forces may be either the same in value or they may differ from each other. The sum of said pulling and pushing forces developed by means of the inductors is insufficient to ensure the assigned reduction of the casting. An additional force required for that purpose is created by the roll drive, which prescribes also the rate of transfer of said movable mill stand.

On completion of the reduction process that is effected by shifting the movable mill stand over a distance A, an idle transfer of said stand is accomplished, with the stand being carried a distance $\Delta l_2$ over a time period $t_3$ under the effect of the pulling force of the inductors 11 and 12.

Further, the rolled portion of the casting is reduced over a time period $t_4$, with the movable mill stand being displaced over a distance B towards the rolled part of the casting owing to the pushing force set up by the inductors 11 and 12, the pulling force created by means of the inductors 13, and the force of the mill roll drive.

As is shown in the diagram and chart of FIGS. 4 and 6, the above-outlined schedule, which ensures the creation of forces applied to the movable mill stand which shift said stand towards the unrolled and rolled portions of the casting, is repeated until the rolling creates a portion of said continuous casting having a length C which corresponds to that of the casting extracted from the mould over the withdrawal period. After that over a time period $t_5$ the movable mill stand performs its idle transfer over a distance C towards the rolled portion of the casting under the effect of the pushing force developed by the inductors 11 and 12.

The rolling process is continued after a period of time $t_6$ which is the pause between the end rolling of the length portion of the casting and the extraction of the next part of the continuous casting from the mould.

Figure 7:
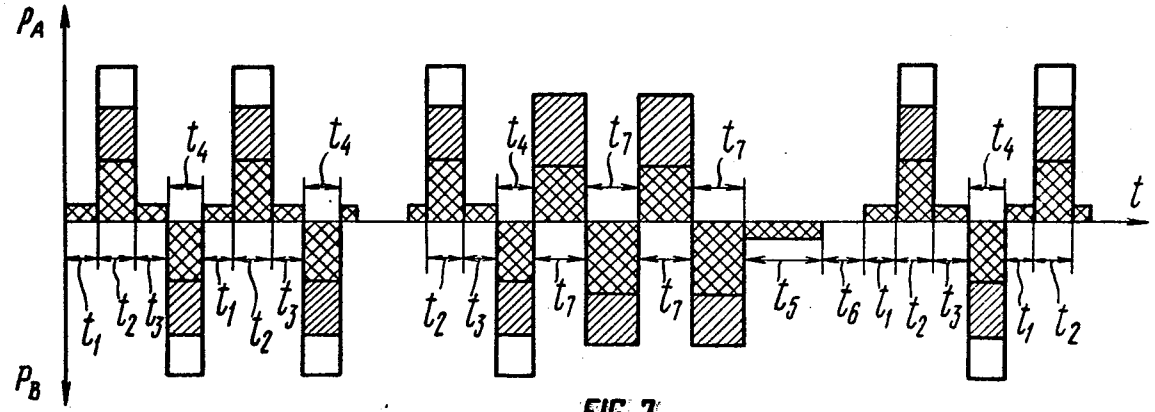
FIG. 7 is a diagram of the forces acting on the movable mill stand, which could provide for additional induction heating of the continuous casting being rolled after several working transfers of said movable mill stand.

In case additional heating of the casting is required or the rolling time of the C-length casting portion is less than the pause between the extractions of said casting from the mould, the rolled portion L of the casting, as well as the section adjacent to said rolled portion, can be heated by inductive currents induced in the casting during the idle transfers of the movable mill stand either over a time period specially given for that purpose or over the time period remaining until the next extraction of the casting from the mould. The schematic drawing illustrating such transfers of the movable stand is given in FIG. 5 and the diagram of forces acting on said movable mill stand is shown graphically in FIG. 7.

Figure 5:
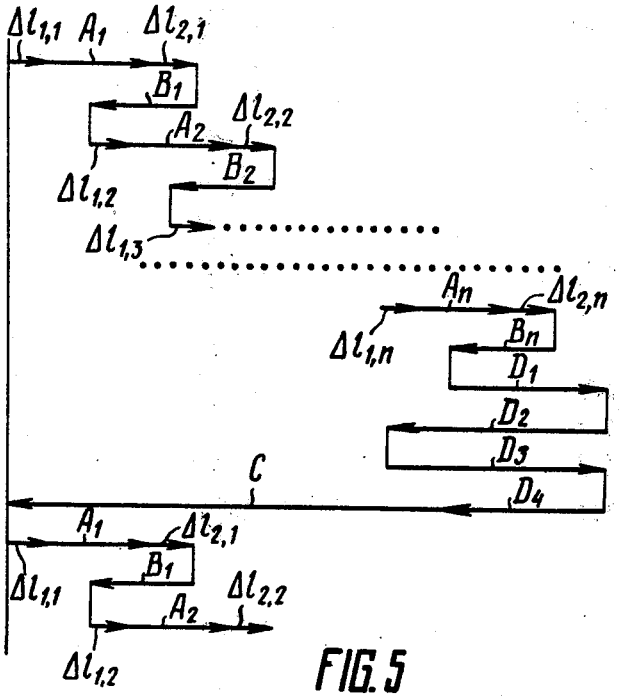
FIG. 5 shows diagrammatically the transfer of the movable mill stand during the steady-state rolling of a continuous casting that is subjected to intense heating after several working transfers of said movable mill stand.

The difference between the schematic drawings of FIGS. 5 and 4 consists in that FIG. 5 shows idle reciprocation of the movable mill stand over a distance D. Accordingly, the forces shown in FIG. 7 acting on the movable mill stand correspond to its idle transfers over the time period $t_7$ at a distance D. According to said schematic diagram, the inductors 11, 12 and 13 create only the pushing forces of a prescribed value acting on said movable mill stand, and to enable an idle transfer of said stand towards the unrolled portion of the continuous casting the pushing force established by the inductors 13 must exceed slightly in value that required for the idle transfer of said movable mill stand along the slideways, whereas with the movable stand being carried towards the rolled part of the casting the force developed by the inductors 11 and 12 must be greater than the above value.

Figure 8:
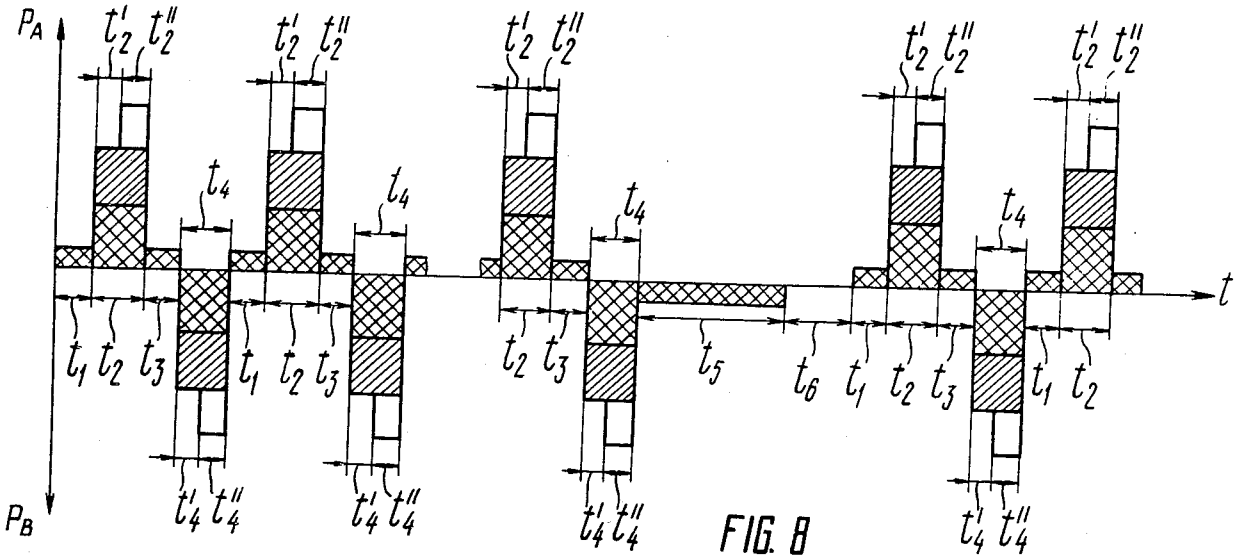
FIG. 8 is a diagram of the forces acting on the movable mill stand, which could provide for additional induction heating of the continuous casting being rolled during rolling.

In case it is expedient that the rolled casting be heated additionally prior to each working stroke of the movable mill stand, the pulling-and-pushing force applied to the stand must approximate the force needed for, but be insufficient for, effecting the assigned reduction during rolling, the stand being held in place in that position over a time period $t_2'$ to $t_4'$, whereupon an additional force is created by the roll drive to carry the movable mill stand over the time period $t_2''$ or $t_4''$ a distance A or B. The diagram of forces applied to the movable stand when using the above rolling schedule is given in FIG. 8.

As to the additional heating of the casting, it can be accomplished during the working transfer of the movable mill stand, if said stand is subjected to the action of a pulling-and-pushing force approximating, but unequal to, the force needed to perform the prescribed reduction of the casting during rolling, the stand transfer time $t_2$ and $t_4$ being extended depending on the required heating of said casting. The diagram of forces acting on the mill stand differs from that shown in FIG. 6 only in said extended time periods $t_2$ and $t_4$.

The herein-proposed mill is also adaptable for rolling a continuous casting in case tensile stresses are developed in the area of deformation, with the casting being exposed to additional heating, which enables a lower roll force to be used.

If that is the case, rolling can be effected in two versions.

Figure 9:
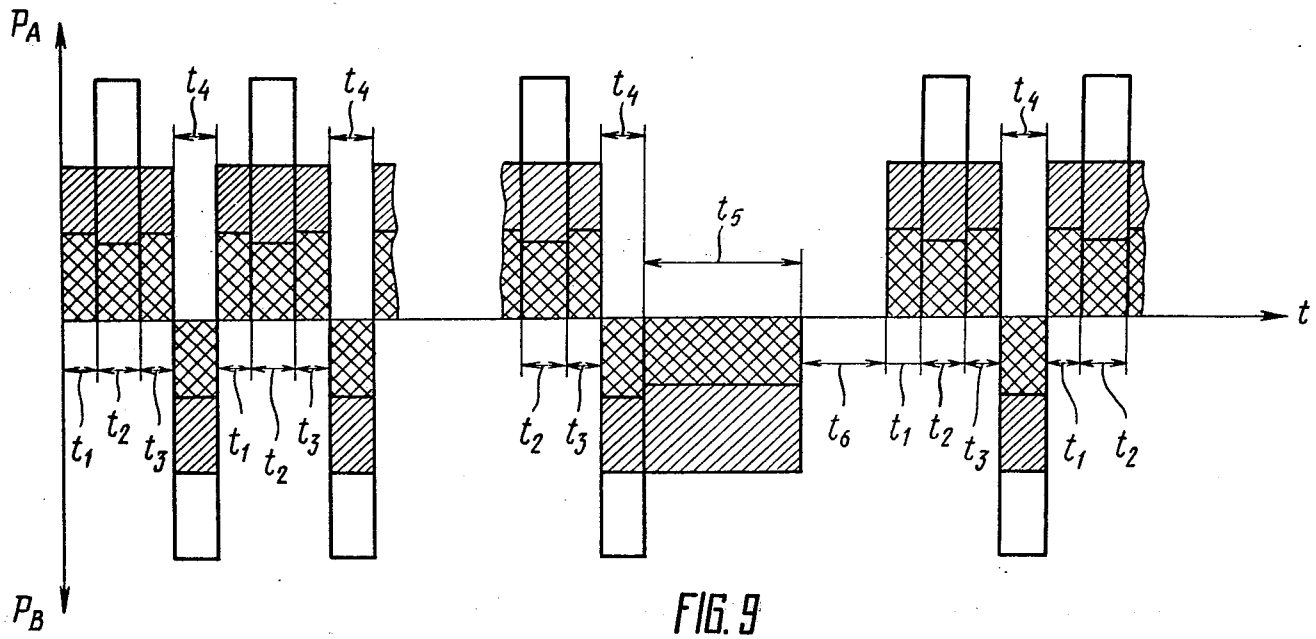
FIG. 9 is a diagram of the forces acting on said movable mill stand, which could provide for induction heating of the continuous casting being rolled, for setting up of tensile stresses in the area of deformation and for the rolling of said casting only by the action of a mill roll drive.

According to the first version (FIG. 9), the same pushing forces created by the inductors 11, 12, and 13 (FIG. 3) over the time period $t_2$ and $t_4$ are applied to the movable mill stand, the casting being rolled within that period only under the effect of a moment created by the mill roll drive, and an idle transfer of the stand at the distances $\Delta l_1$, $\Delta l_2$ and C being performed over the time periods $t_1$, $t_3$ and $t_5$ also due to said pushing forces established by the same inductors 11, 12 and 13 but differing in value.

The second version (FIG. 10) contemplates the setting up of only pushing forces created by the inductors 11, 12 and 13 being applied to said movable mill stand for differing in value during all the periods, this feature ensures an idle transfer of said movable mill stand in the prescribed directions, the rolling of the continuous casting being effected over the time periods $t_2$ and $t_4$ under the effect of both the force of the roll drive and the force created due to the difference in the pushing forces acting on said movable stand developed by said inductors 11, 12 and 13. In the case when the movable mill stand travels during its working transfer towards the unrolled part of the casting, the greater pushing force is developed by the inductors 13 that are mounted on the side of the rolled portion of the casting, while with the movable stand travelling during its working stroke towards the rolled portion of the casting the greater pushing force is set up by the inductors 11 and 12 disposed on the side of the unrolled portion of the casting.

Where the heating of the rolled part of the casting during rolling is objectionable, the direct rolling of a continuous casting on the proposed mill can be effected by applying to its movable stand the forces created in accordance with the schematic diagram presented in FIG. 11. In this case use is made only of the inductors located on the side of the unrolled part of the casting. The pulling force exerted on the stand is created with the help of said inductors when the movable mill stand is carried during its working stroke towards the unrolled part of the casting over a time period $t_2$, the pushing force being applied when said working displacement is directed towards the rolled part of the casting over the time period $t_4$. As for the idle displacements of said movable mill stand, they are also carried out owing to said pulling and pushing forces created by means of the inductors disposed on the side of the unrolled part of the casting.

What we claim is:

1. A mill for rolling a continuously cast ingot, said mill rolling a casting intermittently, said mill having a movable mill stand set up on a stage and travelling along slideways mounted on a foundation, said mill stand comprising: a bottom-mill separator installed on said stage; two housings, each of which incorporating braces, said housing being fastened on said bottom-mill separator; a top-mill separator holding said housings together; grooved mill rolls disposed intermediate of said housings and having roll necks mounted in chock bearings, said chock bearings being located in apertures of said housings; hydraulic drives connected to the necks of said grooved rolls; gear wheels meshed with each other and connected to the necks of said grooved rolls; and at least two pairs of inductors mounted between the braces of said housings on said bottom-mill separator of said mill stand, said inductors being arranged such that in each pair one inductor is above and the other inductor is below the casting being rolled, the inductors being on both sides of said mill rolls , said pair of inductors inducing in said casting to be rolled inductive currents, which heat said casting being rolled, and electromagnetic forces, which create in said inductors pulling and pushing forces which are applied to said mill stand.

2. A mill according to claim 1, wherein mounted on the end face walls of inductors, which are disposed at the entry and exit sides of a continuous casting to be rolled on said mill, are brackets, each of which carries at least one guide roller, said brackets together with the rollers being set up on the end face walls of said inductors so as to provide a required clearance between the casting being rolled and the inductors.

3. A mill of claim 1, wherein an additional pair according to inductors powered from an individual power source is installed on the side of the unrolled parts of said casting.

4. A mill according to claim 1, wherein the end face walls of inductors arranged on the side of the unrolled part of the casting are mounted on a device with processing heads.

* * * * *